United States Patent [19]

Dimmick et al.

[11] Patent Number: 4,682,481

[45] Date of Patent: Jul. 28, 1987

[54] PERSONAL LOCKING DEVICE

[75] Inventors: Gary S. Dimmick, Oakmont; Scott Lockerman, Sewickley, both of Pa.

[73] Assignee: Lockman Products Company, Inc., Pittsburgh, Pa.

[21] Appl. No.: 874,220

[22] Filed: Jun. 13, 1986

[51] Int. Cl.[4] ..... E05B 73/00

[52] U.S. Cl. ..... 70/14; 70/22; 70/29; 70/53; 70/59

[58] Field of Search ..... 70/14, 22, 24, 27, 30, 70/49, 53, 58, 59, 60, 18, 428, 29; 59/78, 79.3, 86, 87, 89

[56] References Cited

U.S. PATENT DOCUMENTS

| | | | |
|---|---|---|---|
| 200,990 | 3/1878 | Deraismes | 70/49 |
| 486,256 | 11/1892 | Leehey et al. | 70/49 |
| 599,765 | 3/1898 | Chase | 70/30 |
| 1,025,284 | 5/1912 | Lybeck | 70/428 |
| 1,222,920 | 4/1917 | Blais | 70/30 |
| 1,267,894 | 5/1918 | Olson | 70/30 |
| 1,472,206 | 10/1923 | Burkle | 70/30 |
| 1,627,462 | 5/1927 | Rohmer | 70/30 |
| 1,632,338 | 6/1927 | Horton | 70/14 |
| 1,857,399 | 5/1932 | Piagneri | 70/27 |
| 3,611,760 | 10/1971 | Muther | 70/18 |
| 3,906,758 | 9/1975 | Hurwitt | 70/30 |
| 4,064,715 | 12/1977 | Hodgson et al. | 70/30 |
| 4,302,955 | 12/1981 | Kawakami | 70/30 |
| 4,398,403 | 8/1983 | Menick | 70/58 |
| 4,490,997 | 1/1985 | Hughes et al. | 70/18 |
| 4,543,806 | 10/1985 | Papandrea et al. | 70/30 |
| 4,597,273 | 7/1986 | Reichenberger | 70/30 |

*Primary Examiner*—Richard J. Scanlan, Jr.
*Assistant Examiner*—Anthony Knight
*Attorney, Agent, or Firm*—Buchanan Ingersoll

[57] ABSTRACT

A conventional barrel-type combination lock receives a lock element extending from a safety pin housing. The safety pin housing pivotally receives a pin that pivots between an open position and a closed position. When the pin is placed in the closed position relative to the safety pin housing, and the lock element of the barrel-type combination lock is moved to the locked position, the end of the pin is positioned within a pin receiving recess on the barrel-type combination lock so that the pin is locked in the closed position. A conventional chain formed from a series of interlocking links is utilized with the lockable safety pin to enable small articles to be locked to fixed objects. When the chain is not in use, it is stored within a cylindrical chain storage container that is threadedly received upon the end of the barrel-type combination lock. With the pin closed and the combination lock in the locked position, and with the chain positioned within the storage container and the storage container threaded onto the lock, the personal locking device is of a size convenient for carrying in a purse or pocket of the potential user.

8 Claims, 14 Drawing Figures

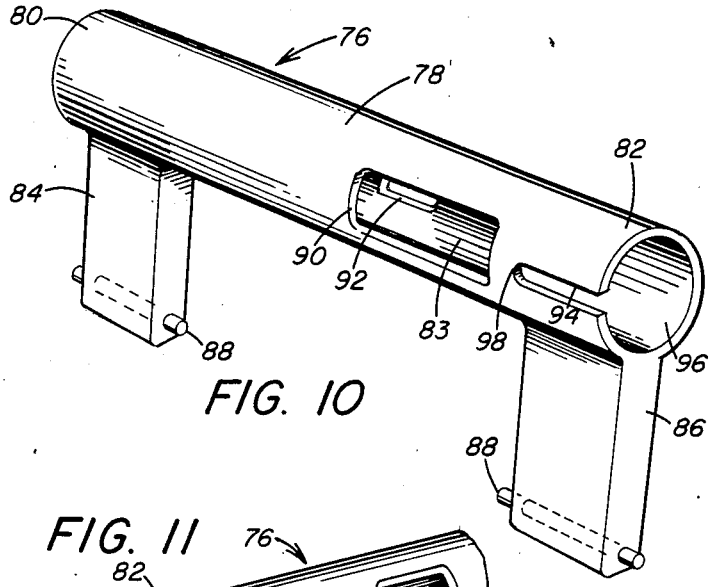
FIG. 10
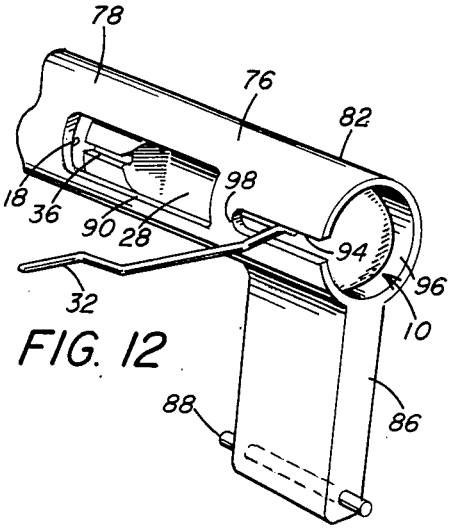
FIG. 12
FIG. 11
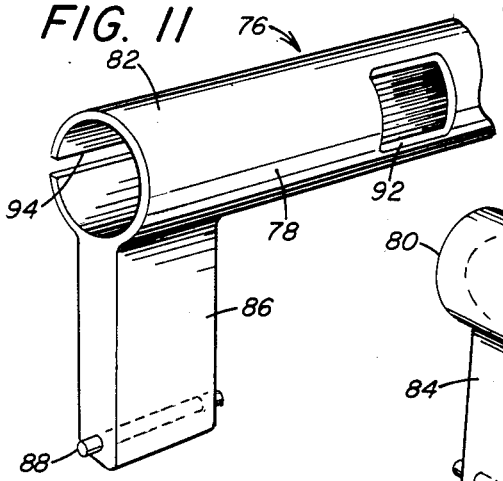
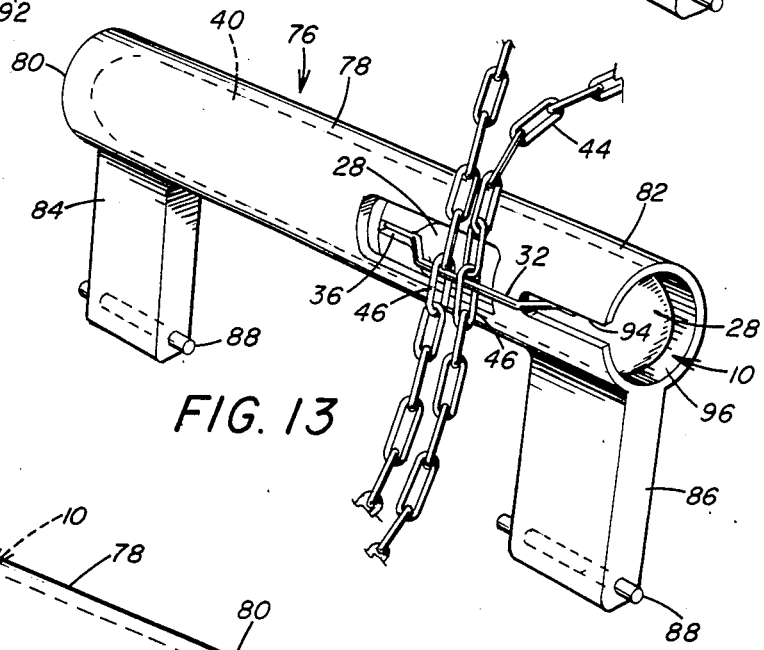
FIG. 13
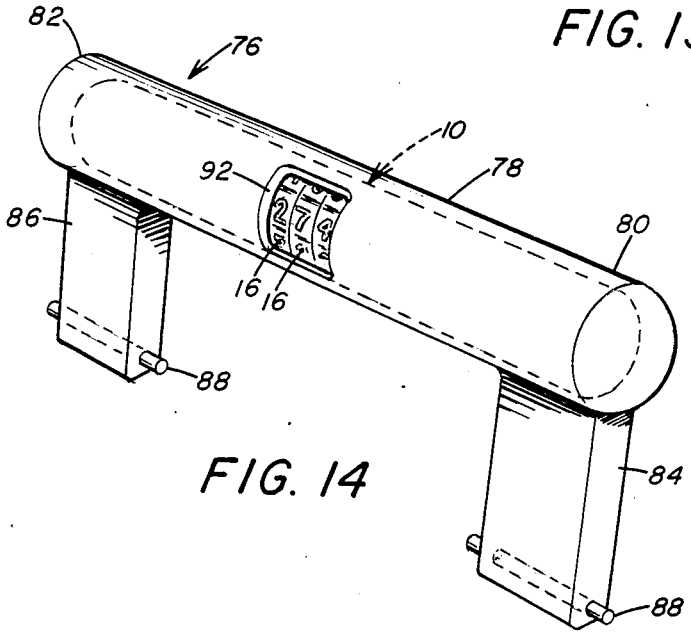
FIG. 14

PERSONAL LOCKING DEVICE

BACKGROUND OF THE INVENTION

1. Field of the Invention

This invention relates to an apparatus for locking personal items to secure them from theft, and more particularly to a locking safety pin-like unit in combination with a chain for locking small personal articles to a fixed object to thereby prevent theft.

2. Description of the Prior Art

Many efforts have been made to provide locking devices with which to secure small articles of personal property such as purses, briefcases, coats, skis, and other personal items when circumstances demand that they be left unattended for periods of time. A common locking device of this character is a chain and padlock utilized to prevent the theft of an unattended bicycle. One device which may be utilized to secure smaller personal articles is shown in U.S. Pat. No. 3,611,760 and consists of a lock and a cable which may be utilized to secure a briefcase to a fixed object. A similar device is shown in U.S. Pat. No. 3,906,758 as well as in U.S. Pat. No. 4,064,715. A bicycle locking device is shown in U.S. Pat. No. 4,490,997 as well as in U.S. Pat. No. 4,302,955. Barrel-type combination locks are well known, an example of which is shown in U.S. Pat. Nos. 1,472,206 and 1,627,462.

While locking devices are well known, none of the devices permit small articles to be locked universally to fixed objects. In most cases the construction of the known locks limits their use to specific applications and are generally cumbersome. Therefore, there is need for a locking device which may be utilized to universally attach small articles to a fixed or stationary object.

SUMMARY OF THE INVENTION

In accordance with the present invention, there is provided a personal locking device that includes a lock having a housing with a pin receiving recess formed therein. The lock housing is adapted to slidably receive a lock element therein. The lock element is movable relative to the lock housing between a locked position and an unlocked position. The lock element has a affixed thereon a pin housing with a pin pivotally retained by the pin housing for movement between an open position and a closed position. The lock element and the lock housing coact with the pin housing so that when the pin is on the closed position on the lock housing, and the lock element is in the locked position the pin is received within the pin receiving recess to thereby lock the pin in a closed position.

Further, in accordance with the present invention, there is provided a self-contained personal locking device that includes a barrel-type combination lock having an outer barrel with a pin receiving recess formed in one end thereof and having threads formed on the other end thereof. The barrel is adapted to slidably receive a lock element therein. The lock element is movable coaxially relative to the barrel between a locked position and an unlocked position. The lock element has affixed thereon a safety pin housing extending coaxially from the barrel. The housing has a pin pivotally retained by the housing for pivotal movement between an open position and a closed position. The lock element and the barrel coact with the safety pin housing so that when the pin is closed relative to the housing the lock element is in the locked position. The pin is received within the barrel pin receiving recess to thereby lock the pin in the closed position. A chain is formed of a plurality of interlocking links. The links are of a size that permit the pin to pass through the chain links. A cylindrical chain storage container is threadedly secured to the barrel in coaxial relation thereto to receive the chain for storage when the chain is not in use.

Accordingly, the principal object of the present invention is to provide a convenient, self-contained personal locking device for securing small articles to fixed objects.

Another object of the present invention is to provide a self-contained personal locking device which is attachable to a large variety of small objects without damage to the objects.

Another object of the present invention is to provide a personal locking device which is easily carried in a pocket or purse and utilized when needed.

These and other objects of the present invention will be more completely disclosed and described in the following specification, the accompanying drawings and the appended claims.

BRIEF DESCRIPTION OF THE DRAWINGS

FIG. 10 is a perspective view of a luggage handle adapted to receive the personal locking device of the present invention.

FIG. 11 is a fragmentary perspective view of the luggage handle, illustrating the side opposite the side shown in FIG. 10.

FIG. 12 is a fragmentary perspective view, illustrating the locking device in the handle with the safety pin in an open position.

FIG. 13 is a perspective view, illustrating the chain retained on the safety pin locked in a closed position to lock the locking device to the handle and the chain to the locking device.

FIG. 14 is a view similar to FIG. 13, illustrating an opening in one side of the handle to provide access to the combination lock within the handle.

DESCRIPTION OF THE PREFERRED EMBODIMENT

Figure 1:
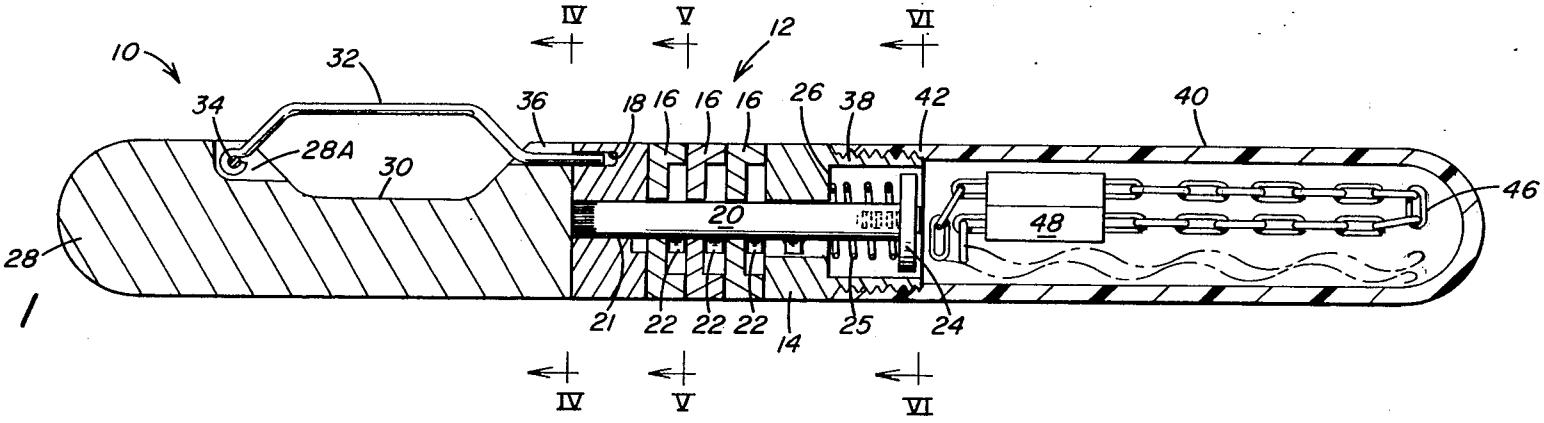
FIG. 1 is a sectional view of the personal locking device of the present invention shown in the locked position.
Figure 2:
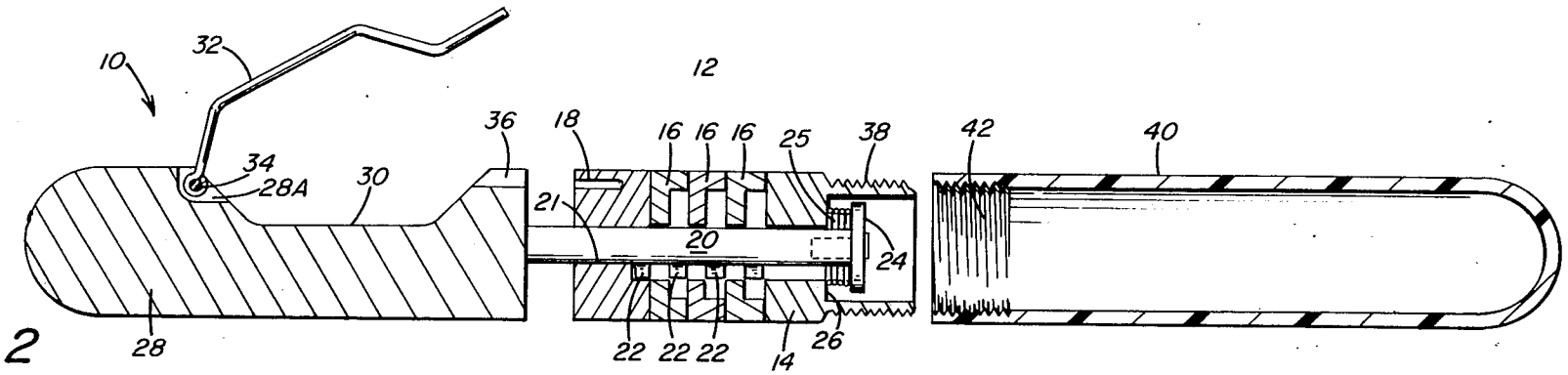
FIG. 2 is a sectional view of the personal locking device of the invention shown in the unlocked position and with the chain storage container removed therefrom.
Figure 3:
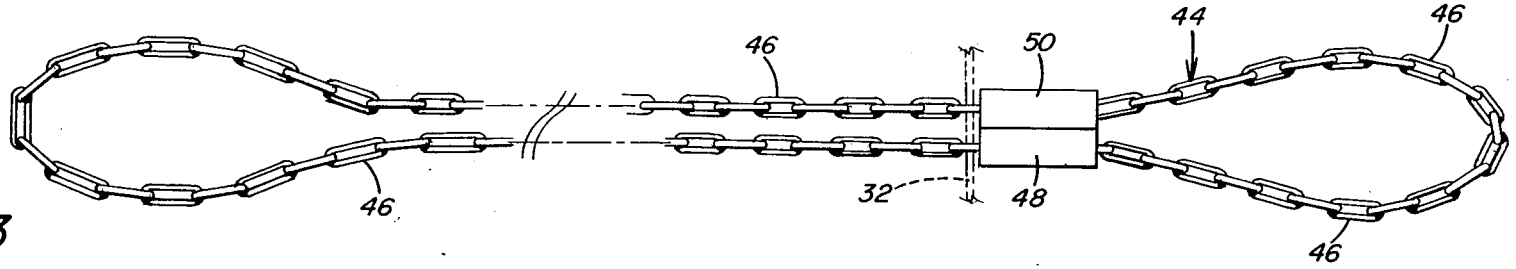
FIG. 3 is a plan view of the chain of the present invention having a choke slidable thereon.
Figure 4:
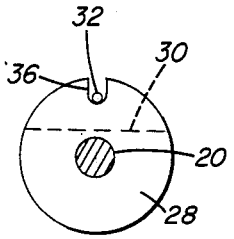
FIG. 4 is a sectional view taken along line IV—IV of FIG. 1.
Figure 5:
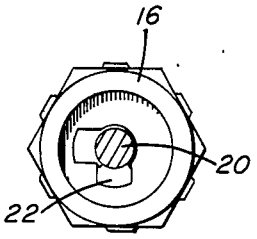
FIG. 5 is a sectional view taken along line V—V of FIG. 1.

Referring to the drawings, and particularly to FIGS. 1 and 2, there is shown a personal locking device 10 having a barrel-type combination lock 12 which is conventional in design and therefore will not be described in detail. Known barrel-type combination locks are disclosed in U.S. Pat. Nos. 1,222,920; 1,267,894; 1,472,206, and 1,627,462.

In conventional fashion, the lock 12 has a barrel 14 upon which are received a plurality of tumbler wheels 16. The tumbler wheels have recesses (not shown) so that when the recesses are aligned, the lock is in an open position. When the recesses are not aligned, the lock is in a locked position in a manner that is well known in the art. The tumbler wheels 16 have numerals (not shown) around the circumference of each wheel 16 so that when the recesses are aligned the numerical combination of the lock appears in alignment on adjacent tumbler wheels in conventional fashion. Even though the above combination lock is described for use with the present invention, it should be understood that other types of locks, such as conventional key locks, are equally adaptable to the present invention.

Formed in one end of the barrel 14 is a pin receiving recess 18. A lock element 20 is positioned in a central bore 21 of the barrel 14 and moves in sliding, axial relation to the barrel 14 between the locked position shown in FIG. 1 and the unlocked position shown in FIG. 2. Again, in conventional fashion, when the tumbler wheels 16 are positioned so that the lock is in the open position, the lock element 20 is freely slidable through the barrel 14.

In order to lock the combination lock 12, the lock element 20 is moved to the position shown in FIG. 1. Then the tumbler wheels 16 are rotated. In the locked condition, the tumbler wheels 16 enter recesses 22 formed on the lock element 20 and prevent the lock element from moving.

Figure 6:
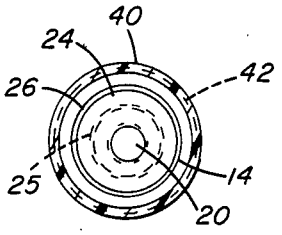
FIG. 6 is a sectional view taken along line VI—VI of FIG. 1.

Affixed to one end of the lock element 20 is a stop member 24 which is movable toward and away from an annular wall 26 of barrel 14 when the lock element 20 is moved between the open and closed positions as shown in FIGS. 1 and 2. The stop member 24 prevents lock element 20 from being completely withdrawn from the barrel 14. A spring 25 surrounds the lock element 20 and abuts at end the stop member 24 and at the opposite end the barrel annular wall 26. The spring 25 exerts a force on the stop member 24 to normally urge the lock element 20 into the barrel bore 21, as shown in FIGS. 1 and 6. The spring 25 is shown in a compressed position in FIG. 2.

Affixed to the opposite end of lock element 20 from stop member 24 is a safety pin housing 28 which is of generally cylindrical shape and which has a recess 30 formed therein. The safety pin housing 28 also has a groove 28*a* formed to receive the pivoted end of a pin 32. The pin 32 is movably retained on the housing 28 by pivotally connecting the pin 32 to the housing 28 by pivot 34. The housing 28 also has a pin receiving groove 36 to receive the free end of pin 32 when the pin 32 is in the closed position as shown in FIG. 1.

As is best seen in FIG. 1, when the pin 32 is closed the free end of pin 32 fits into pin receiving groove 36 of housing 28. A portion of pin 32 protrudes beyond safety pin housing 28 and into the pin receiving recess 18 of barrel 14. With the lock element 20 in the locked position shown in FIG. 1, the pin 32 is locked in the closed position and may not be opened. When lock element 20 is moved to the open position shown in FIG. 2, the end of pin 32 is withdrawn from pin receiving recess 18 and may be pivoted about pivot 34 to the open position shown in FIG. 2. Threads 38 are formed on the end of the barrel 14 opposite from safety pin housing 28 to threadedly receive a cylindrical chain storage container 40. The chain storage container 40 has threads 42 formed thereon which mate with threads 38 formed on barrel 14. The cylindrical chain storage container 40 is preferably formed from a lightweight material such as a rigid plastic or aluminum. The mating threads 38 and 42 can be eliminated for a frictional engagement of the container 40 and barrel 14.

A chain 44 is provided for use as part of the personal locking device of the present invention. When the locking device is not in use, the chain is stored within the storage container 40 as shown in FIG. 1. The chain 44 is formed from a plurality of individual interlocking links 46 in conventional fashion.

Figure 7:
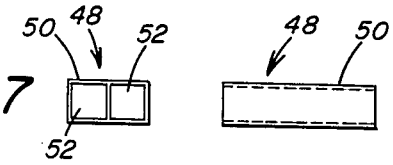
FIG. 7 includes a end view and a side view of the choke for the chain shown in FIG. 3.

In one embodiment the chain 44 is a single continuous loop that twice passes through a choke 48 (shown in FIG. 7) formed of a body member 50 having a pair of passages 52 through which the chain passes. In another embodiment (not shown) the chain 44 is a selected length having unconnected end portions. In operation, the choke 48 can be moved along the chain to vary the effective size of the loop of the chain 44.

When the personal locking device 10 is in the locked position as shown in FIG. 1 and the chain 44 is stored within the storage container 40 as shown in FIG. 1, the entire personal locking device 10 has an overall length of approximately seven inches and has a diameter of approximately one inch. It is lightweight and may be readily carried in the purse or pocket of the user until the device is needed for use.

Figure 8:
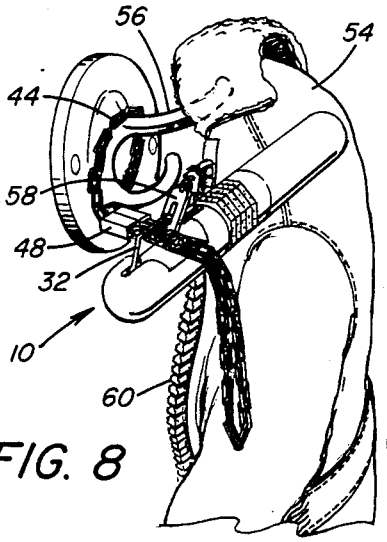
FIG. 8 is a perspective view of the personal locking device, illustrating use of the device to lock a garment to a wall hook.

FIG. 8 illustrates one example of use of the locking device 10 to lock a garment, such as a coat 54 to a wall hook 56. First one end of the loop chain 44 is wrapped tightly around the wall hook 56. The choke 48 is advanced on the chain 44 to close the loop of the chain 44 tightly around the hook 56. With the choke 48 in this position, the pin 32 is passed through the links 46 that are closest to the choke 48 as shown in FIG. 8. The coat 54 is then secured to the chain 44 by passing the unlocked pin 32 through the hole of the zipper closure 58 of coat zipper 60. The pin 32 is then inserted, as above described, in the barrel recess 14 to lock the pin 32 in the closed position. Thus the chain 44 is locked to both the coat 54 and hook 56.

Figure 9:
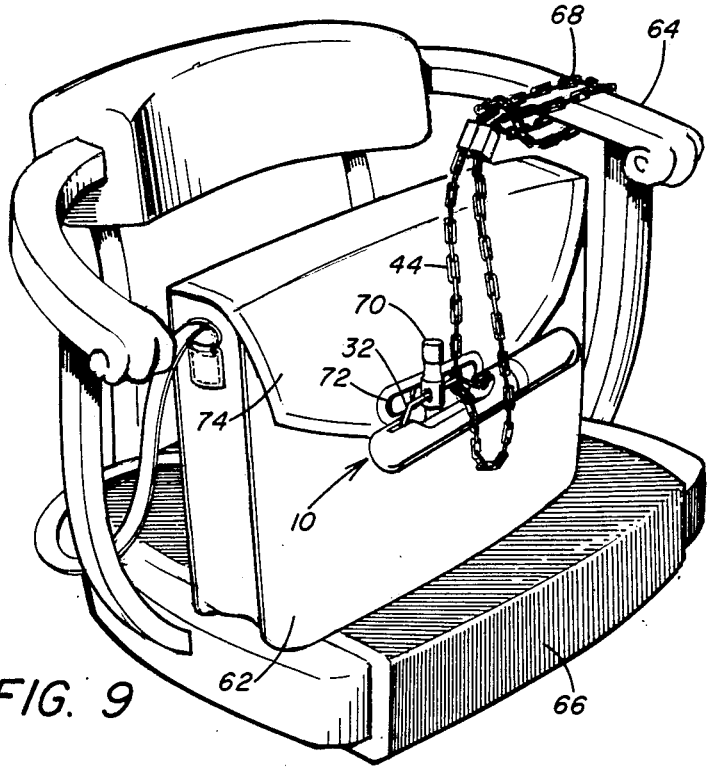
FIG. 9 is a perspective view of the personal locking device, illustrating use of the device to lock a handbag to a chair.

FIG. 9 illustrates a similar example of use of the locking device 10 to secure a handbag 62 to an arm 64 of a chair 66. In this application the chain 44 is looped around the arm 64 and through itself to form a noose 68 around the arm 64. In this case the choke 48 is left free to slide on the chain 44 because the noose 68 around the chair arm 64 prevents separation of the chain 44 from the chair 66.

The locking device 10 is then secured to the handbag 62 by passing the open pin 32 through an aperture, or the like, in a closure element 70 of handbag 62. Conventionally the element 70 extends through an opening 72 of a flap 74 of the handbag 62 to close the handbag. When the pin 32 is moved to the locked position on the barrel 14 not only is the device 10 secured to the handbag 62, the handbag flap 74 is locked in a closed position, as seen in FIG. 9.

It should be understood that the personal locking device of the present invention can be utilized to secure any number of small articles such as a handbag or a garment to fixed objects. The above examples are only representative of a few of the many applications of the locking device 10 of the present invention.

Now referring to FIGS. 10–14 there is illustrated the feature of the present invention of integrally incorporating the locking device 10 in a luggage handle 76 or the like to not only facilitate securing the associated luggage to a stationary object but facilitate efficient integration of the locking device 10 and luggage handle 76 when the locking device 10 is in use and when not in use.

The luggage handle 76 is specifically adapted for use with the locking device 10 even though the handle 76 is substantially conventional in design. As seen in FIGS. 10 and 11 the handle 76 includes an elongated tubular body portion 78 supported adjacent opposite end 80 and 82 by integral posts 84 and 86. The extreme ends of the posts receive pins 88 by which the handle 76 is conventionally secured to the frame of a piece of luggage, briefcase, purse or the like (not shown).

The body portion 78 may be selectively fabricated. For example it can be molded plastic, metal cast, all leather constructed or a combination of these and other suitable materials. The body portion 78 is formed preferably with the end 80 closed and the end 81 open to receive the entire locking device 10 with the storage container 40 attached to the barrel 14 in a cavity 83.

To accommodate storage and use of the locking device 10, the body portion 78 adjacent the end 82 has oppositely positioned apertures 90 and 92. Aperture 90 shown completely in FIG. 10 is positioned to expose the connection of the pin 32 in the pin receiving recess 18 of the barrel 13. The aperture 90 is enlarged to the degree to permit movement of the pin 32 into and out of locked position as shown in FIGS. 12 and 13.

The aperture 92, shown completely in FIGS. 11 and 14, is positioned on the opposite side of the body portion 78 to expose the tumbler wheels 16 of the combination lock 12 when the lock 12 is in an operative position within the cavity 83 of the body portion 78. The wheels 16 are exposed to permit manipulation of the wheels for unlocking the pin 32 from the barrel recess 18.

Associated with the aperture 90 on one side of the body portion 78 is an elongated slot 94 that extends from an opening 96 at end 82 to a closed end portion 98 which is spaced closely to the aperture 90. The slot 94, as shown in FIGS. 12 and 13, receives the pin 32 as the lock 10 is advanced into the cavity 96. With this arrangement the pin 32 extends out of the cavity 83 and overlying the body portion 78. The free end of the pin 32 overlies the aperture 90 for pivotal movement into and out of engagement with the aligned groove 36 and recess 18 to thereby lock and unlock the locking device 10 to the luggage handle 76.

As shown in FIG. 13 the chain 44 is used with the pin 32 as above described. With the pin 32 in the open position shown in FIG. 12, selected links 46 of the chain 44 are positioned on the pin 32. Thereafter the pin 32 is moved to the closed position shown in FIG. 13 to lock the chain 44 to the locking device 10. This has the effect of locking the chain 44 to the handle 76 and the associated luggage. Thus a convenient arrangement is available for securing the luggage by the locking device 10 to a stationary object. At the same time the locking device 10 becomes an integral part of the luggage.

The locking device 10 is always conveniently available for use on the handle 76. When not needed for locking operations, the chain 44 is stored in the container 40 and the locking device 10 is, in turn, locked to the handle 76 preventing removal of the device 10 from the handle 76. In operation with the chain 44 secured to the pin 76, a variety of methods can be utilized, as above discussed to secure the chain 44 to a stationary object.

According to the provisions of the patent statutes, we have explained the principal, preferred construction and mode of operation of our invention and have illustrated and described what we now consider to represent its best embodiment. However, it should be understood that, within the scope of the appended claims, the invention may be practiced otherwise than as specifically illustrated and described.

We claim:

1. A personal locking devise comprising, a safety pin, a lock having a housing with a pin receiving recess formed to be axially aligned with said safety pin, a lock element slidably received within said lock housing, said lock element being movable axially relative to said lock housing between a locked position and an unlocked position.

said lock element having affixed thereon a safety pin housing, said safety pin retained by said pin housing for movement between an open position and a closed position wherein said safety pin end is axially aligned with said pin receiving recess, and said lock element and said lock housing coacting with said pin housing so that when said pin is in the closed position on said lock housing and said lock element is in the locked position the end of said pin is received within said pin receiving recess to thereby lock said pin in a closed position.

2. A personal locking device comprising, a lock having a housing with a pin receiving recess formed therein, a lock element slidably received within said lock housing, said lock element being movable relative to said lock housing between a locked position and an unlocked position, said lock element having affixed thereon a pin housing, a pin retained by said pin housing for movement between an open position and a closed position, said lock element and said lock housing coacting with said pin housing so that when said pin is in the closed position on said lock housing and said lock element is in the locked position said pin is received within said pin receiving recess to thereby lock said pin in a closed position, a chain for wrapping around a fixed object, said chain being formed of a plurality of interconnecting links, and said pin adapted to pass through both an article to be secured and through the said links of said chain and thereafter positioned in said locked position to simultaneously secure said chain to the fixed object and to lock the article to said chain.

3. A personal locking device as set forth in claim 2 wherein, said chain is formed in a closed loop having a choke device slidably positioned thereon.

4. A self-contained personal locking device comprising, a barrel-type combination lock having an outer barrel with a pin receiving recess formed in one end thereof and having threads formed on the other end thereof, a lock element slidably received within said barrel and movable coaxially relative to said barrel between a locked position and an unlocked position, said lock element having affixed thereon a safety pin housing extending coaxially from said barrel, said housing having a pin pivotally retained by said housing for pivotal movement between an open position and a closed position, said lock element and said barrel coacting with said safety pin housing so that when said pin is in the closed position on said housing and said lock element is in the locked position said pin is received within said barrel pin receiving recess to thereby lock said pin in the closed position, a chain formed of a plurality of interlocking links, said links being of a size to permit said pin to pass through said links, and a cylindrical chain storage container threadedly secured to said barrel in coaxial relation thereto to receive said chain for storage when said chain is not in use.

5. A self-contained personal locking device as set forth in claim 4 wherein, said chain is formed in a closed loop having a choke device slidably positioned thereon.

6. A self-contained personal locking device as set forth in claim 4 wherein, said safety pin housing is formed in a generally cylindrical shape with a recessed portion removed from said cylindrical shape to provide a spaced relationship between said housing and said pin when said pin is in the closed position.

7. A self-contained personal locking device as set forth in claim 6 wherein, said barrel, said cylindrical chain storage container and said safety pin housing are all of substantially the same diameter.

8. A self-contained personal locking device as set forth in claim 7 wherein, said cylindrical chain storage container is formed of rigid material.

* * * * *